United States Patent [19]

Sim

[11] Patent Number: 5,005,222

[45] Date of Patent: Apr. 9, 1991

[54] TOILET ASSEMBLY

[76] Inventor: Jae K. Sim, 619 S. Orange Dr., Los Angeles, Calif. 90036

[21] Appl. No.: 541,741

[22] Filed: Jun. 21, 1990

[51] Int. Cl.[5] ..... E03D 9/05

[52] U.S. Cl. ..... 4/216

[58] Field of Search ..... 4/347-352, 4/213, 216, 217

[56] References Cited

U.S. PATENT DOCUMENTS

| | | | |
|---|---|---|---|
| 2,228,920 | 1/1941 | Baither | 4/213 |
| 2,297,935 | 10/1942 | Baither | 4/213 |
| 2,329,221 | 9/1943 | Sanford | 4/213 |
| 2,443,705 | 6/1948 | Fitzgerald | 4/213 |
| 2,575,778 | 11/1951 | Wilson | 4/213 |
| 2,817,099 | 12/1957 | Fitzgerald | 4/215 |
| 2,847,682 | 8/1958 | Shay | 4/213 |
| 3,495,282 | 2/1970 | Taggart | 4/213 |
| 3,805,304 | 4/1974 | Ikehata | 4/72 |
| 4,222,129 | 9/1980 | Baker | 4/213 |
| 4,232,406 | 11/1980 | Beeghly et al. | 4/213 |
| 4,318,192 | 3/1982 | Williams et al. | 4/213 |
| 4,365,361 | 12/1982 | Sanstrom | 4/213 |
| 4,494,255 | 1/1985 | Drummond | 4/213 |
| 4,864,664 | 9/1989 | Higgins | 4/213 |

*Primary Examiner*—Charles E. Phillips

*Attorney, Agent, or Firm*—Birch, Stewart, Kolasch & Birch

[57] ABSTRACT

A toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion senser disposed on the front exterior of the toilet holding tank and free of interference from the opening and closing of a toilet seat cover, a multifunctional tube having an U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion senser is actuated to operate the fan member and the objectionable odor is ventilated, and in turn when the user stands and flushes the toilet assembly, the motion senser is deactivated and simultaneously the flush water discharges the waste product and associated objectional odor directly to the sewer discharge line.

8 Claims, 3 Drawing Sheets

2
2
17
26
24
39
18
19
20
25
25'
21
16
11
11'
22
13
10
14
23
15
12
43
42
40
41

20
31
32
24
25
26
19
39
11
13
44
43
42
45
46
40
47
12
54
48
49
41
51
53
52

TOILET ASSEMBLY

BACKGROUND OF THE INVENTION

1. Field of the Invention

The present invention relate to a toilet assembly and more particularly, to a ventilating toilet assembly which includes a toilet stool having a ventilation conduit disposed adjacent to the back wall portion of the toilet stool for ventilating objectionable odor from the toilet bowl, the ventilation conduit extending annularly around the siphon conduit at the point where they communicate with a sewer discharge line, a fan means disposed in the lower portion of the ventilation conduit, a toilet holding tank having a motion senser disposed on the front exterior of the toilet holding tank and free of interference from the opening and closing of the toilet seat cover, a multifunctional tube having an U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion senser is actuated to operate the fan means and the objectionable odor is ventilated, and in turn when the user stands and flushes the toilet assembly, the motion senser is deactivated and simultaneously the flush water discharges the waste product and associated objectionable odor directly to the sewer discharge line.

2. Field of the Prior Art

Various types of ventilating toilets are generally known to be utilized with a fan means for ventilating a contaminated air through a separate exhaust duct. Several types of ventilating toilets are known to be utilized with a gas exhaust duct disposed adjacent to a toilet stool and connected to a sewer discharge line or a siphon conduit. However, these toilets suffer from a number of problems such as, for example, (1) the waste product and associated objectionable odor does not clearly discharge directly to a sewer discharge line since the ventilating conduit is directly connected to the sewer discharge line or the siphon conduit, (2) it is very complicated in construction, expensive to manufacture, and difficult in use, (3) since the flush water flows backward to the ventilating conduit, an amount and a water pressure of the flush water are minimized so that these toilets cannot be effectively achieved the flush purpose thereof, and (4) since such toilets are utilized with a relay type or an on/off switch for activating a fan means, this switch may be gotten out of order frequently. Furthermore, such toilets do not disclose the use of a water overflowing system and if they have it, it is very complicated and it does not work effectively. Such toilets are described in Baither U.S. Pat. No. 2,227,920, Baither U.S. Pat. No. 2,297,935, Sanford U.S. Pat. No. 2,329,221, Fitzgerald U.S. Pat. No. 2,443,705, Wilson U.S. Pat. No. 2,575,778, Fitzgerald U.S. Pat. No. 2,817,099, Shay U.S. Pat. No. 2,847,682, Taggart U.S. Pat. No. 3,495,282, Ikehata U.S. Pat. No. 3,805,304, Baker U.S. Pat. No. 4,222,129, Beeghly et al U.S. Pat. No. 4,232,406, Williams et al U.S. Pat. No. 4,318,192, Sanstrom U.S. Pat. No. 4,365,361, Drummond U.S. Pat. No. 4,494,255, and Higgins U.S. Pat. No. 4,865,664.

SUMMARY OF THE INVENTION

Accordingly, it is an object of the present invention to provide an improved ventilating toilet assembly, whereby objectionable odor from the toilet bowl is effectively vented therefrom and discharged into a sewer discharge line.

Another object of the present invention is to provide a toilet assembly which includes a toilet stool having a ventilation conduit disposed adjacent to the back wall portion of the toilet stool for ventilating objectionable odor from the toilet bowl, the ventilation conduit extending annularly around a siphon conduit at the point where they communicate with the sewer discharge line, a fan means disposed in the lower portion of the ventilation conduit, a toilet holding tank having a motion senser disposed on the front exterior of the toilet holding tank and free of interference from the opening and closing of the toilet seat cover, a multifunctional tube having an U-shaped configuration and disposed in toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the seat cover, while the user sits on the seat ring, the motion senser is actuated to operate the fan means and the objectionable odor is ventilated, and in turn when the user stands and flushes the toilet assembly, the motion senser is deactivated and simultaneously the flush water discharges the waste product and associated objectionable odor directly to the sewer discharge line.

A further object of the present invention is to provide a toilet assembly which further comprises a water overflow controlling ball valve disposed to move in a net chamber disposed at the top area of a gas exhaust tube for, upon overflowing of the flush water, allowing to discharge overflowing water thereinto.

Yet another object of the present invention is to provide a toilet assembly which is simple in construction, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a toilet assembly which includes a toilet stool having a ventilation conduit disposed adjacent to the back wall portion of the toilet stool for ventilating objectionable odor from a toilet bowl, the ventilation conduit extending annularly around a siphon conduit at the point where they communicate with a sewer discharge line, a fan member disposed in the lower portion of the ventilation conduit, a toilet holding tank having a motion senser disposed on the front exterior of the toilet holding tank and free of interference from the opening and closing of a toilet seat cover, a multifunctional tube having an U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion senser is actuated to operate the fan member and the objectionable odor is ventilated, and in turn when the user stands and flushes the toilet assembly, the motion senser is deactivated and simultaneously the flush water discharges the waste product and associated objectionable odor directly to the sewer discharge line.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
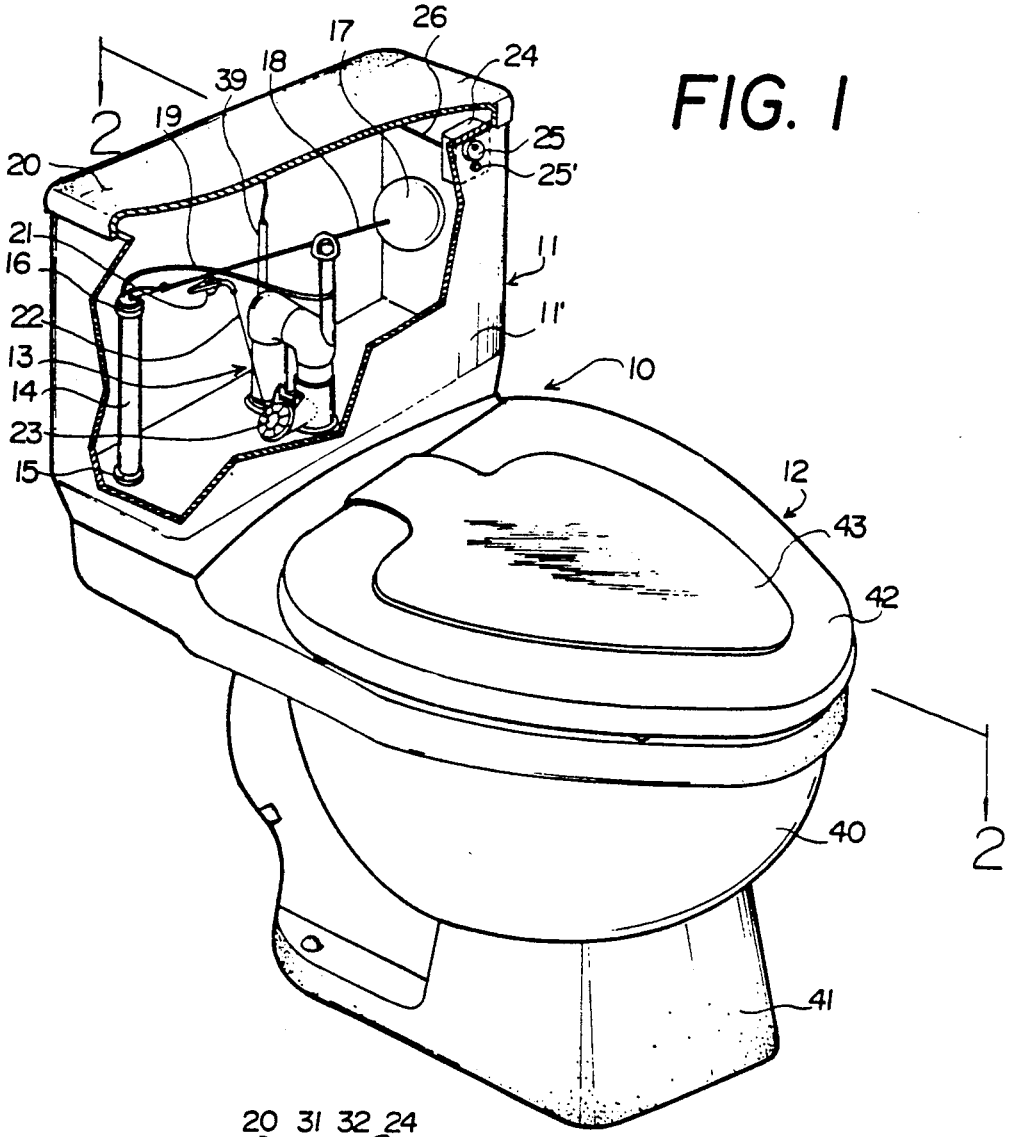
FIG. 1 is a perspective view of the toilet assembly according to the present invention containing cut away portions in order to illustrate the construction thereof.
Figure 2:
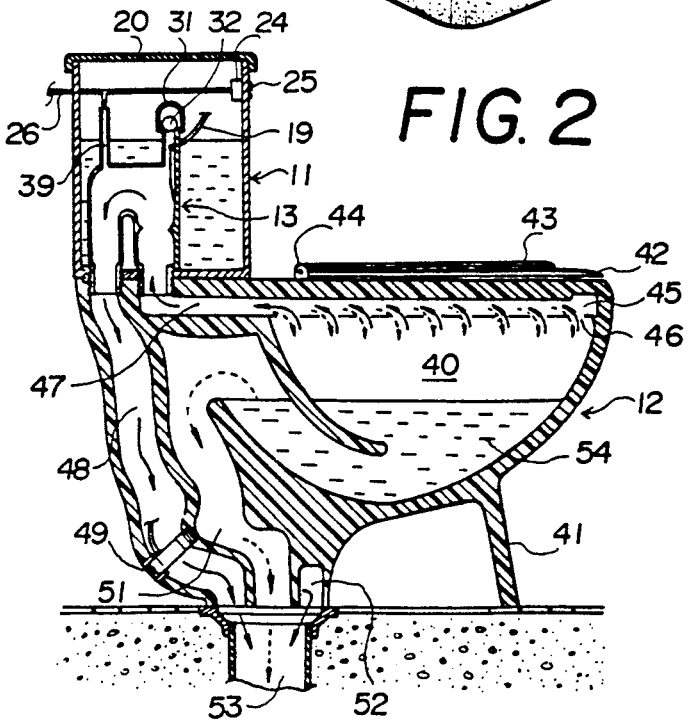
FIG. 2 is a sectional view of FIG. 1, taken along lines 2—2.
Figure 3:
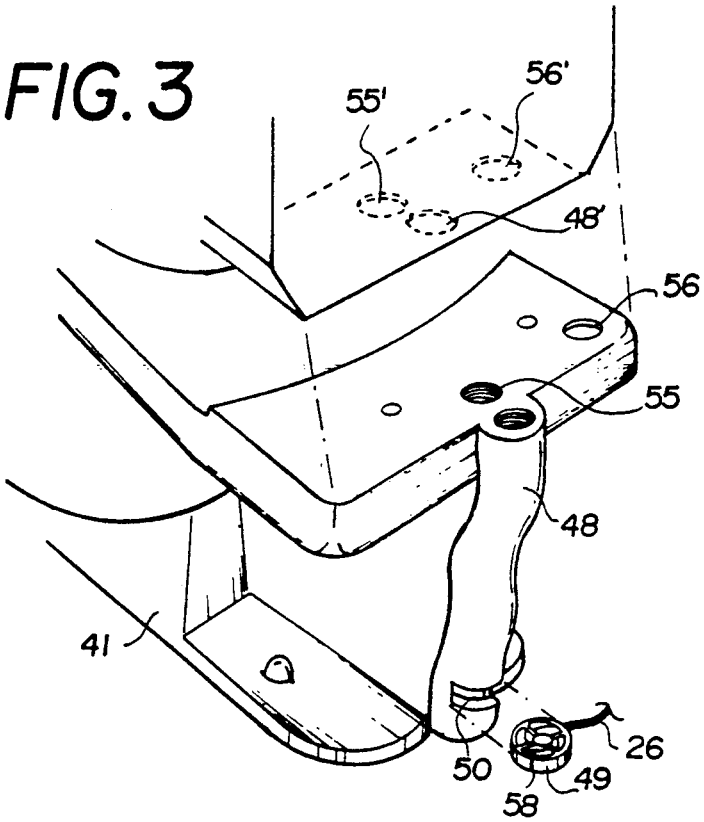
FIG. 3 is an exploded perspective view of a ventilation conduit disposed adjacent to the back wall portion of the toilet stool according to the present invention.
Figure 5:
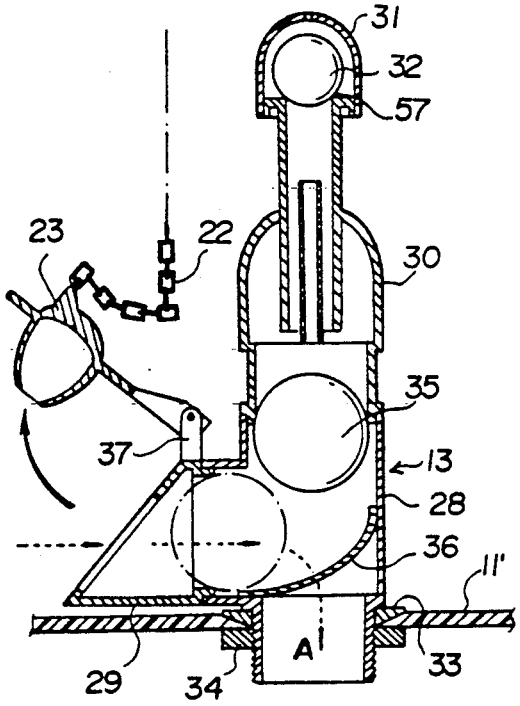
FIG. 5 is a sectional view of the multifunctional tube showing a flapper valve in an open position.
Figure 6:
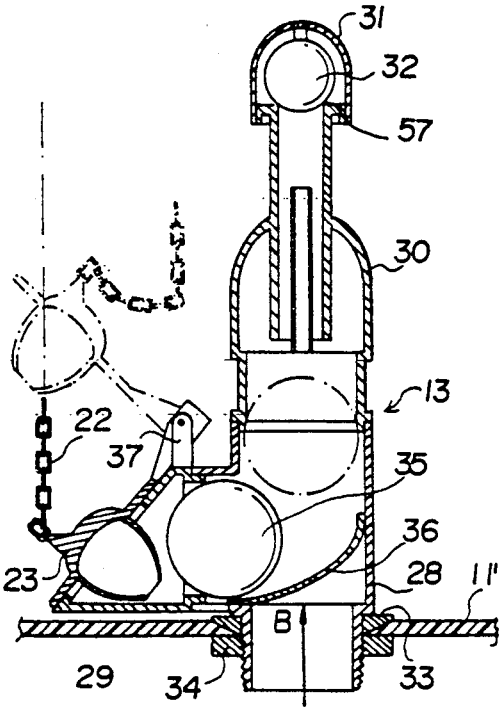
FIG. 6 is a sectional view of the multifunctional tube showing the flapper valve in a closed position.
Figure 7:
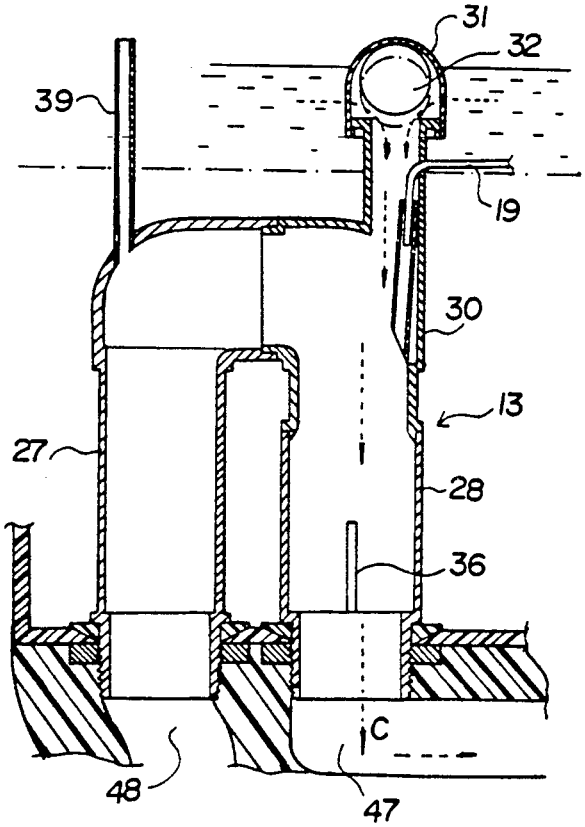
FIG. 7 is a sectional view of the multifunctional tube showing the water overflow controlling ball valve in an operation.

Referring now in detail to the drawings for the purpose of illustrating preferred embodiments of the present invention, the toilet assembly 10 as shown in FIGS. 1, 2, and 3, comprises a toilet holding tank 11, a toilet stool 12, a ventilation conduit 48 disposed adjacent to the back wall portion of the toilet stool 12, a motion senser 24 disposed on the front exterior of the toilet holding tank 11, and a multifunctional tube 13 disposed in the toilet holding tank 11 and provided with a movable ball valve 35 disposed therein (FIGS. 5 and 6).

As shown in FIG. 2, the toilet stool 12 includes a toilet bowl 40, a flush ring 45 disposed at the upper end of the toilet bowl 40, a plurality of openings 46 communicating with the flush ring 45 for allowing fresh flush water 54 to be flushed into the toilet bowl 40 from the flush ring 45, a seat ring 42 disposed on the flush ring 45, a small toilet seat cover 43 disposed on the peripheral inside edge of the seat ring 42, and a siphon conduit 51 connected to and communicating with the toilet bowl 40 for discharging waste product and associated objectionable odor directly from the toilet bowl 42 to a sewer discharge line 53.

As shown in FIGS. 2 and 3, the ventilation conduit 48 for ventilating objectionable odor from the toilet bowl 40 extends an annular wide end portion 52 disposed annularly around the siphon conduit 51 at the point where they communicate with the sewer discharge line 53. And the ventilation conduit 48 contains a fan means 49 disposed in the lower portion thereof. Thus, since the annular wide end portion 52 disposed at the bottom end of the ventilation conduit 48 is disposed annularly around the end portion of the siphon conduit 51 and is connected directly to the sewer discharge line 53, the waste product and associated the objectionable odor can be completely discharged when compared with the conventional vent toilet assemblies. The fan means 49 is inserted into a groove 50 disposed in the lower portion of the ventilation conduit 48 and includes a water-proof fan motor 58 connected to an electric source (not shown) through an electric wire 26 which is passed along the ventilation conduit 48, the multifunctional tube 13 and a wire containing line 39 and connected to the motion senser 24 and the electric source. Also, the electric wire 26 is covered by a water-proof material.

As shown in FIG. 1, the toilet holding tank 11 contains the flush water 54 to be flushed into the toilet bowl 45 from the flush ring 45 of the toilet stool 12. The toilet holding tank 11 includes a water supply tube 14 connected to a water supply line (not shown) through a water intake valve 15 disposed at the bottom end thereof, a float valve 16 disposed at the top end thereof, a float member 17 connected to the float valve 16 through a rod 18, and a flush handle 21 disposed on the front exterior of the toilet holding tank 11 for connection to a flapper valve 23 through a chain 22. The water supply tube 14 stands at apertures 56 and 56' disposed at the toilet holding tank 11 and the toilet stool 12, respectively (FIG. 3).

The motion senser 24 is disposed on the front exterior of the toilet holding tank 11 in the opposite side to the flush handle 21 and includes a detector 25 and a senser acting light 25' (FIG. 1). Also, the motion senser 24 is not an on/off type switch or a relay type switch so that the motion senser 24 is durable when compared with the switch of the conventional vent toilet assemblies. Furthermore, since the toilet seat cover 43 disposed on the peripheral inside edge of the seat ring 42 has a small size when compared with the conventional toilet seat cover, the motion senser 24 is free of interference from the opening and closing of the toilet seat cover 43 (FIG. 1). The motion senser 24 is connected to the electric source (not shown) with DC 12 volts. Also, the motion senser 24 is actuated to operate the fan means 49 while the user sits on the seat ring 42 upon opening the small toilet seat cover 43 and in turn the motion senser 24 is deactivated when the user stands. On the other hand, the user is apart from the predetermined area from the motion senser 24, the motion senser 24 is inoperative. The predetermined area is about 1 foot from the motion senser 24.

Figure 4:
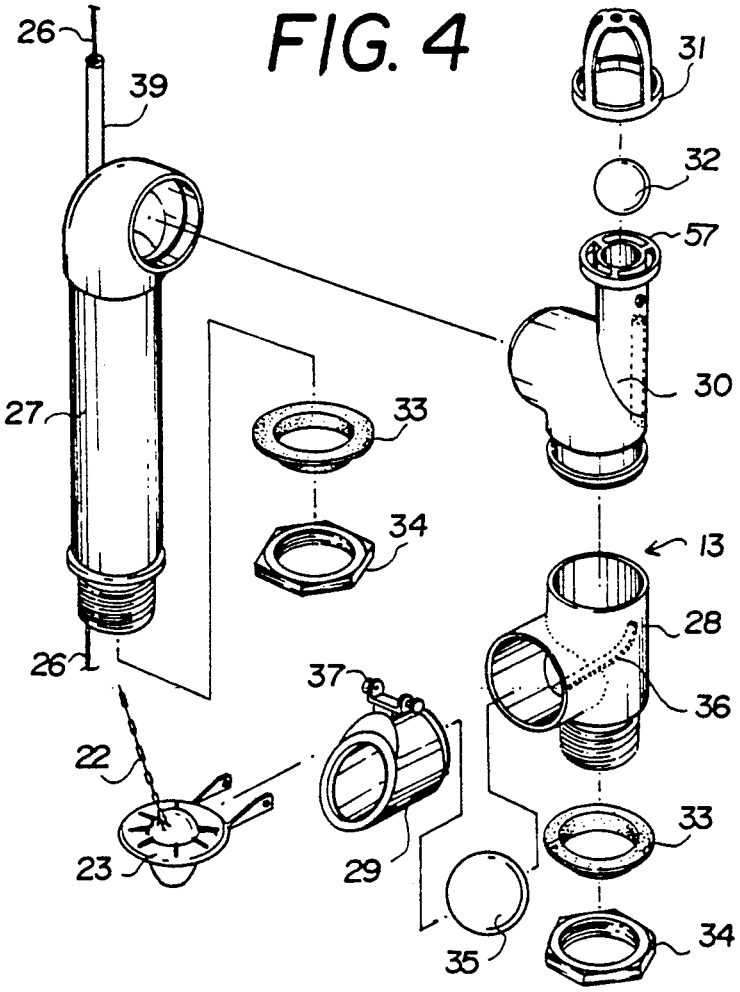
FIG. 4 is an exploded perspective of a multifunctional tube disposed in the holding tank according to the present invention.

As shown in FIGS. 3 and 4, the multifunctional tube 13 has an U-shaped configuration and disposed in the toilet holding tank 11. The multifunctional tube 13 is provided with an L-shaped gas exhaust tube 27 connected to the ventilation conduit 48 at the bottom end thereof through an aperture 48' of the holding tank 11 for allowing exhaust gas to flow from the flush ring 45 through a tunnel 47 to the ventilation conduit 48, a first T-shaped tube 30 connected to the top end of the L-shaped gas exhaust tube 27 at a center branch thereof, and a second T-shaped tube 28 connected to the bottom end of the first T-shaped tube 30 at the top end thereof. The L-shaped gas exhaust tube 27 is provided with the wire containing line 39 at the top portion thereof for containing the electric wire 26 which is connected to the water-proof fan means 49 and the electric source (not shown). The multifunctional tube 13 is connected to and communicates with the ventilation conduit 48 and the flush ring 45 so that a kind of sealing system for the toilet holding tank 11 does not require when compared with the conventional vent toilets.

The first T-shaped tube 30 is provided with a ball seat 57 disposed at the top thereof and a net ball cap 31 extending from the ball seat 57 for moving a water overflow controlling movable ball valve 32 between the ball seat 57 and the net ball cap 31 so as to allow to discharge overflowing flush water 54 from the toilet holding tank 11 thereto by the float of the water overflow controlling movable ball valve 32 upon overflowing the flush water 54. A water hose 19 is connected to the upper portion of the first T-shaped tube 30 for allowing fresh water 54 to be passed into the first T-shaped tube 30.

As shown in FIGS. 3 and 4, the second T-shaped tube 28 is connected to the tunnel 47 at the bottom end thereof through apertures 55 and 55' of the toilet stool 12 and the toilet holding tank 11, respectively. And the second T-shaped tube 28 is provided with a horizontal flapper tube 29 extends the middle portion thereof and a C-shaped guide line 36 disposed in the center portion of the T-shaped tube 28 for guiding the movable ball valve 35 along the C-shaped guide line 36. Also, the flapper valve 29 has an inclined inlet for easily closing and opening by the flapper valve 23. The flapper valve 23 is pivotally connected to the flapper tube 29 by a hinge 37. The chain 22 is connected to the flapper valve 23 and the flush handle 16. Therefore, upon pushing the flush handle 16, the flapper valve 23 is opened to flow the flush water 54 to the toilet bowl 40.

Thus the L-shaped tube 27, the first T-shaped tube 30, and the second T-shaped tube 28 are tightly connected to each other by utilizing washers 33 and nuts 34.

The movable ball valve 35 is disposed to move between the flapper valve 23 and the second T-shaped tube 28 along the C-shaped guide line 36 for allowing exhaust gas to flow from the flush ring 45 to the ventilation conduit 48 or the flush water 54 to flow from the toilet holding tank 11 to the toilet bowl 40.

According to the present invention, the toilet assembly 10 operates as follows:

First of all, upon opening the toilet seat cover 43, while the user sits on the seat ring 45, the motion senser 24 is actuated to operate the fan means 49 and simultaneously the senser acting light 25 is actuated. At this time, the objectionable odor from the toilet bowl 40 through the plurality of openings 46 and the tunnel 47 is ventilated and discharged to the ventilation conduit 48 and directly to the sewer line 53 through the annular wide end portion 52. At that time, as shown in FIG. 6, the movable ball valve 35 moved down along the C-shaped guide line 36 due to the gravity tightly closes the flapper tube 29. Therefore, the objectionable odor gas from the toilet bowl 40 exhausts to the second T-shaped tube 28 and continuously the first T-shaped tube 30, the L-shaped tube 27, the ventilation conduit 48, and finally the sewer discharge line 53 in the direction indicated by arrow (B) shown in FIG. 6. Also, the water overflow controlling ball valve 32 tightly closes the ball seat 57 of the first T-shaped tube 30. Thus, the multifunctional tube 13 continuously maintains a vacuum state so that the objectionable odor gas is effectively ventilated.

Second, as shown in FIG. 5 in turn when the user stands and flushes the toilet assembly 10 by pushing the flush handle 21, the motion senser 24 is inoperative and simultaneously the flapper valve 23 is open and the movable ball valve 35 moves up along the C-shaped guide line 36 due to the water pressure to close the top end of the second T-shaped tube 28. Therefore, the flush water 54 flows to the toilet bowl 40 from the toilet holding tank 11 therethrough in direction indicated by arrow (A) as shown in FIG. 5. At this time, simultaneously the flush water 54 effectively discharges the waste product and associated objectionable odor directly to the sewer discharge line 53 through the siphon conduit 51. At that time, the waste product does not plug up the ventilation conduit 48 when compared with the conventional vent toilets. Because the ventilation conduit 48 extends annularly around the siphon conduit 51 at the point where they communicate with the sewer discharge line 53.

When the float valve 16 and/or the float member 17 are out of order, the flush water 54 overflows the toilet holding tank 11. At this time, the overflowing water makes the water overflow controlling valve 32 to move up. Therefore, the water overflow controlling movable valve 32 is released from the ball seat 57 to open so as to allow to discharge overflowing flush water form the toilet holding tank 11 to the toilet stool 12 therethrough.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilating toilet assembly comprising:

a toilet stool having a toilet bowl, including a back wall, a flush ring disposed at the upper end of said toilet bowl, a plurality of openings communicating with said flush ring for allowing flush water to be flushed into the toilet bowl from the flush ring, a seat ring disposed on said flush ring, a toilet seat cover disposed on the peripheral inside edge of said seat ring, and a siphon conduit connected to and communicating with the toilet bowl for discharging waste product directly from the toilet bowl to a sewer discharge line, a ventilation conduit disposed adjacent to the back wall portion of said toilet stool for ventilating objectionable odor from the toilet bowl, said ventilation conduit extending annularly around said siphon conduit at a point where they communicate with said sewer discharge line, said ventilation conduit containing a fan disposed in the lower portion thereof, a toilet tank for containing flush water, said toilet tank having a water intake valve and an opening leading to said bowl, a motion senser disposed on the front exterior of said toilet holding tank facing said stool, said sensor being free of interference from the opening and closing of the toilet seat cover, a multifunctional tube having an inverted U-shaped configuration with one leg of the U being disposed in said opening in said toilet tank, which leg serves as a first gas exhaust tube connected to said flush ring, a horizontal flapper tube extending laterally of said one leg and having a flapper valve seated thereon, a second leg of said U being connected to said ventilation conduit, and serving as a second gas exhaust tube, a movable ball valve disposed to move between a first position in said flapper tube adjacent said flapper valve to a second position in said first gas exhaust tube for allowing exhaust gas to flow from the flush ring to the ventilation conduit in said first position or flush water to flow from the toilet holding tank via flapper tube to the toilet bowl in said second position, whereby with the toilet seat cover open, while the user sits on the seat ring, the motion senser is actuated to operate the fan and the objectionable odor is ventilated, and in turn when the user stands and flushes the toilet assembly, the motion senser is deactivated and simultaneously, the flush water discharges the waste product and associated objectionable odor directly to the sewer discharge line.

2. The ventilating toilet assembly of claim 1, wherein the second gas exhaust tube is provided with a ball seat disposed at the top portion thereof for containing a water overflow controlling movable ball valve so as to discharge overflowing flush water from the toilet holding tank to the toilet stool.

3. The ventilating toilet assembly of claim 2, wherein the ball seat is provided with a net ball cap supported by said ball seat for allowing movement of said ball valve between the net ball cap and the ball seat.

4. The ventilating toilet assembly of claim 11, wherein the gas exhaust tube contains a C-shaped ball guide line for allowing movement of the ball along the C-shaped ball guide line.

5. The ventilating toilet assembly of claim 1, wherein the fan contains a water-proof fan motor.

6. The ventilating toilet assembly of claim 1, wherein the motion senser contains a detector and senser acting light and is connected to the electric source with DC 12 volts.

7. The ventilating toilet assembly of claim 6, wherein the motion senser is inoperative when the user is apart from the predetermined area therefrom.

8. The ventilating toilet assembly of claim 7, wherein the predetermined area is about 1 foot from the motion senser.

* * * * *